US005247829A

United States Patent [19]

Ehlig-Economides

[11] Patent Number: 5,247,829

[45] Date of Patent: Sep. 28, 1993

[54] METHOD FOR INDIVIDUALLY CHARACTERIZING THE LAYERS OF A HYDROCARBON SUBSURFACE RESERVOIR

[75] Inventor: Christine Ehlig-Economides, Garches, France

[73] Assignee: Schlumberger Technology Corporation, Houston, Tex.

[21] Appl. No.: 600,360

[22] Filed: Oct. 19, 1990

[51] Int. Cl.[5] ..... E21B 47/00; E21B 49/00

[52] U.S. Cl. ..... 73/155; 166/250

[58] Field of Search ..... 73/153, 155; 166/250

[56] References Cited

U.S. PATENT DOCUMENTS 4,597,290 7/1986 Bourdet et al. ..... 166/250

4,893,504 1/1990 O'Meara, Jr. et al. ..... 73/153

FOREIGN PATENT DOCUMENTS 1416681 8/1988 U.S.S.R. ..... 73/153

*Primary Examiner*—Hezron E. Williams

*Assistant Examiner*—George Dombroske

*Attorney, Agent, or Firm*—Henry N. Garrana; John H. Bouchard

[57] ABSTRACT

The invention relates to reservoir evaluation and is more specifically directed to a method of characterizing the individual response of a layer of a multi-layer hydrocarbon reservoir traversed by a well, based on downhole flow rate and pressure measurements performed during transient tests initiated by changes in the surface flow rate of the well, the flow rate being measured above said layer during one transient test and below said layer during another transient test. The variations of downhole pressure and flow rate with respect to their respective values at the initiation of the transient test are determined, each of said flow rate variations is normalized by the pressure variation after the same time interval within the same transient test, thereby to produce a first pressure-normalized flow rate function for the level above said layer and a second pressure-normalized flow rate function for the level below said layer, and said first and second pressure-normalized flow rate functions are subtractively combined to generate a function representative of the individual response of said layer.

4 Claims, 5 Drawing Sheets

FIG.3 (CONT'D)

A

27

COMPUTE SLOPE, $a$, OF LATE-TIME PRESSURE DERIVATIVE ON PLOT OF $\log\left[\frac{d\Delta p_{wf}(\Delta t)}{dt_{sup}}\right]$ VERSUS $\log(\Delta t)$

28

COMPUTE SLOPE, $m_e$, FOR SAME LATE-TIME DATA ON PLOT OF $p_{wf}(\Delta t)$ VERSUS $(\Delta t)^a$ FOR $a \neq 0$, OR $p_{wf}(\Delta t)$ VERSUS $\ln(\Delta t)$ FOR $a=0$

29

COMPUTE $p_{supe}(\Delta t_i)$ USING EQ.(20)[1] FOR $a \neq 0$, OR $$p_{supe}(\Delta t_i) = \frac{m_e}{Q_{n+1}-Q_n}\sum_{j=0}^{n-1}(Q_{j+1}-Q_j)\ln\left(\frac{T_n-T_j}{T_n-T_j+\Delta t_i}\right), \text{ FOR } a=0$$

30

COMPUTE THE DECONVOLUTION, $\Delta p_{ddJ,J+1}(\Delta t_i)$, FROM THE FOLLOWING SYSTEMS OF EQUATIONS:

$$\Delta p_{wf}(\Delta t_i) - p_{supe}(\Delta t_i) = \sum_{i=0}^{k,l-1}(Q_{i+1}-Q_i)_{J,J+1}\Delta p_{ddJ,J+1}(T_{k,l}-t_i)$$

DATA SMOOTH ? (31) — Y → 32, N → 33

32

IF THE $\Delta p_{ddJ,J+1}(\Delta t_i)$ ARE SUFFICIENTLY SMOOTH, COMPUTE THE RPNR DERIVATIVE AS FOLLOWS:

$$\frac{d\Delta p_{ddIJ}(\Delta t_i)}{d\ln(\Delta t)} = (RPNR_{IJ}(\Delta t_i))^2\left[\frac{d\Delta p_{ddJ}(\Delta t_i)}{d\ln(\Delta t)}(PNR_J(\Delta t_i))^2 - \frac{d\Delta p_{ddJ+1}(\Delta t_i)}{d\ln(\Delta t)}(PNR_{J+1}(\Delta t_i))^2\right]$$

33

IF THE $\Delta p_{ddJ,J+1}(\Delta t_i)$ ARE NOT SUFFICIENTLY SMOOTH, COMPUTE $$t_{SFRC_0} = \frac{1}{(q_0-q_k)}\left[\sum_{i=1}^{k-1}(q_0-q_i)\ln\left(\frac{T_k-t_{i-1}}{T_k-t_{k-1}}\right)+(q_0-q_k)\ln(t_k-t_{k-1})\right]$$

34

COMPUTE APPROXIMATE RPNR DERIVATIVE:

$$\frac{dRPNR_{IJ}(\Delta t_i)}{d\ln(\Delta t)} = (RPNR_{IJ}(\Delta t_i))^2\left[\frac{d|p_{supe}(\Delta t_i)-RNP_J(\Delta t_i)|}{dt_{SFRC_0}}(PNR_J(\Delta t_i))^2 - \frac{d|p_{supe}(\Delta t_i)-RNP_{J+1}(\Delta t_i)|}{dt_{SFRC_0}}(PNR_{J+1}(\Delta t_i))^2\right]$$

WHERE $RNP_{J,J+1}(\Delta t_i) = \frac{1}{PNR_{J,J+1}(\Delta t_i)}$

METHOD FOR INDIVIDUALLY CHARACTERIZING THE LAYERS OF A HYDROCARBON SUBSURFACE RESERVOIR

BACKGROUND OF THE INVENTION

The subject matter of the present invention relates to a method for individually characterizing, from the standpoint of production performance, each of the producing layers of a hydrocarbon reservoir traversed by a well.

An accurate and reliable evaluation of a layered reservoir requires an evaluation on a layer-by-layer basis, which involves that relevant parameters, such as permeability, skin factor, and average formation pressure, can be determined for each individual layer.

A first conceivable approach for analyzing individual layers is to isolate each layer by setting packers below and above the layer, and to perform pressure transient tests, involving the measurement of downhole pressure. The layer is characterized by selecting an adequate model, the selection being accomplished using a log-log plot of the pressure change vs. time and its derivative, as known in the art. But this method is less than practical as packers would have to be set and tests conducted successively for each individual layer.

An alternative approach relies on downhole measurements of pressure and flow rate by means of production logging tools. A proposal for implementing this approach has been to simultaneously measure the flow rate above and below the layer of interest, whereby the contribution of the layer to the flow would be computed by simply subtracting the flow rate measured below the layer from the flow rate measured above this layer. This in effect would provide a substitute for the isolation of a zone by packers. But this proposal has suffered from logistical and calibration difficulties that have thwarted its commercial application. A more practical testing technique, called Multilayer Transient (MLT) testing technique, is described by Shah et al, "Estimation of the Permeabilities and Skin Factors in Layered Reservoirs with Downhole Rate and Pressure Data" in SPE Formation Evaluation (September 1988) pp. 555–566. In this technique, downhole measurements of flow rate are acquired with only one flowmeter displaced from one level to another level. Flow rate measurements are thus acquired at different times. However, because fluctuations may occur in the surface flow rate, and also because the change imposed on the surface flow rate to initiate a transient is of arbitrary magnitude, it is not possible to determine the contribution of an individual layer by simply subtracting from each other the flow rates measured below and above the layer. This complicates the interpretation of test data.

SUMMARY OF THE INVENTION

Accordingly, it is a primary object of the present invention to enable each layer of a multi-layer reservoir to be characterized on an individual basis from downhole flowrate and pressure transient measurements.

It is a further object of the present invention to enable such characterization without imposing impractical requirements on such characterization insofar as acquisition of measurement data is concerned.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

In the case of a single-layer hydrocarbon reservoir, well testing techniques allow the properties (permeability, skin factor, average formation pressure, vertical fracture, dual porosity, outer boundaries, . . . ) of the reservoir—more exactly, of the well-reservoir system—to be determined. A step change is imposed at the surface on the flow rate of the well, and pressure is continuously measured in the well. Log-log plots of the pressure variations vs. time and of its derivative are used to select a model for the reservoir, and the parameters of the model are varied to produce a match between modelled and measured data in order to determine the properties of the reservoir.

Figure 1A:
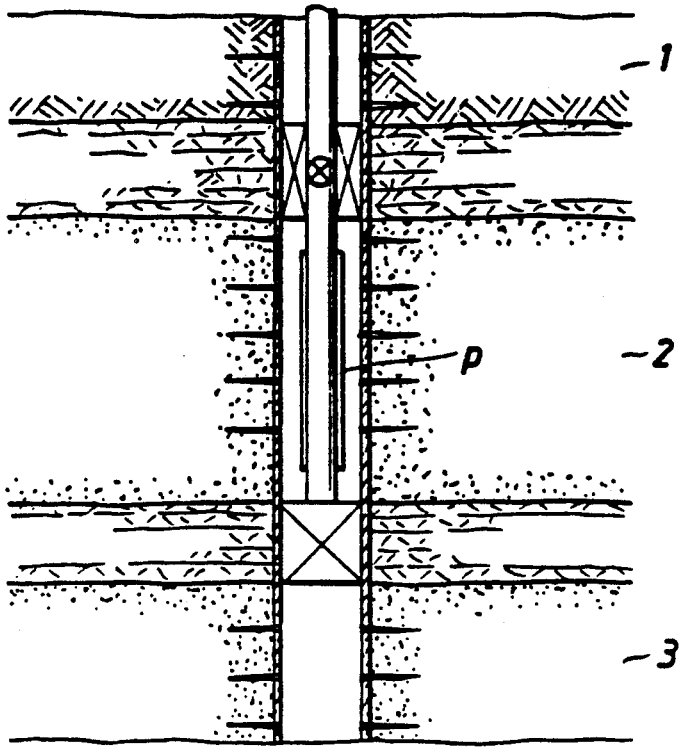
FIG. 1A illustrates the isolated zone testing technique, in the case of a three-layer reservoir.
Figure 1B:
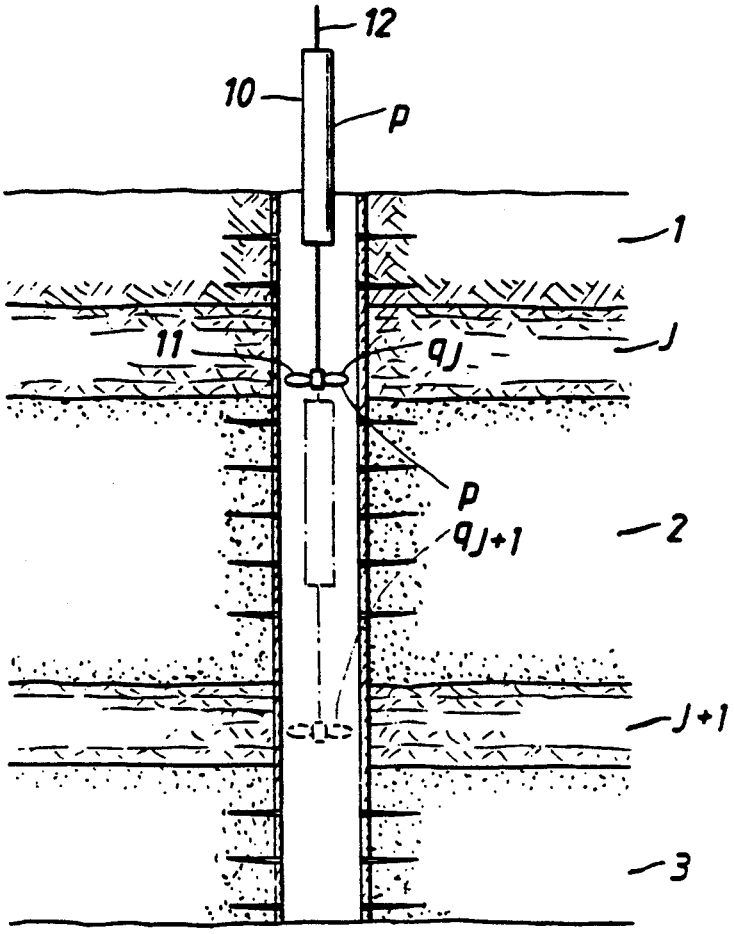
FIG. 1B illustrates the multilayer transient (MLT) testing technique.

In the case of a layered reservoir such as the three-layer reservoir shown in FIGS. 1A and 1B, a complete characterization of the reservoir implies the determination of such parameters as permeability, skin factor, average pressure (and others where applicable) for each of the individual layers, because the same model cannot be assumed for all layers. Therefore, such parameters can only be derived from well test data if an adequate model can be ascertained for each layer.

FIG. 1A illustrates the conventional testing technique in which fluid communication between the well and the reservoir is restricted to a particular zone isolated by means of packers set above and below this zone, and a test is performed by first flowing the well and then shutting it in, and measuring the variations vs. time of the pressure in the well during the time the well is shut in. Such a technique allows the response of each individual layer to be analyzed, one at a time, since the pressure measured in the isolated portion of the well will only depend on the properties of the flowing layer.

Figure 4:
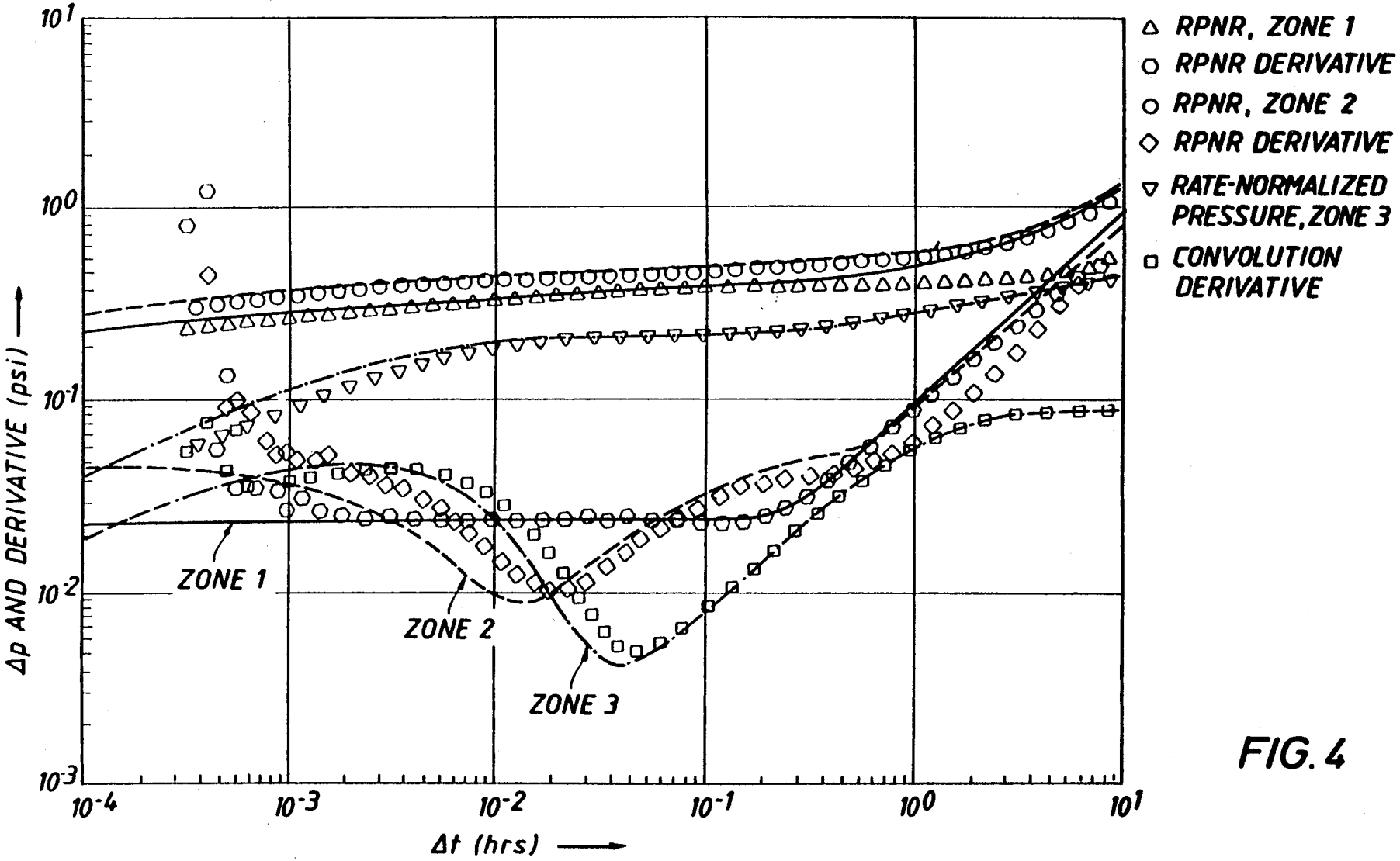
FIG. 4 compares the results of the method of the invention with those obtained from the isolated testing technique, based on a simulated example.

FIG. 4 shows simulated pressure and pressure derivative plots vs. elapsed $\Delta t$-the elapsed time for each isolated zone test starting from the onset of flow. For computing the simulation, the following properties have been used for the respective layers:

| Reservoir and Fluid Properties for Simulated Example | | | | | | | | |
|---|---|---|---|---|---|---|---|---|
| Layer | h(ft) | Φ | k(md) | Skin | $x_f$(ft) | λ | ω | $r_e$(ft) |
| 1 | 10 | 0.20 | 300 | 3 | — | — | — | 200 |
| 2 | 15 | 0.15 | 100 | 0 | — | 1.10–4 | 0.05 | 200 |
| 3 | 50 | 0.10 | 15 | — | 50 | 5.10–5 | 0.01 | ∞ |
| | $r_w$ = 0.4 ft | | | | B = 1.0 RB/STB | | | |
| | $c_t$ = 1.10–5/psi | | | | μ = 1.0 cp | | | |

with the following definitions:
h thickness of the layer
Φ porosity
k permeability
$x_f$ vertical fracture half-length
λ interporosity flow parameter
ω storativity ratio
$r_e$ external boundary radius FIG. 4 shows respective pressure and pressure derivative plots for zones 1, 2 and 3. For instance, layer 1 is characterized by the pressure and pressure derivative curves in full line. By identifying such features in these curves as the slope of the late-time portion, etc, a model can be diagnosed for layer 1. For more information on model selection, reference is made to Ehlig-Economides, C.: "Use of Pressure Derivative in Well Test Interpretation" SPE-Formation Evaluation (June 1989) 1280–2.

FIG. 1B illustrates an alternative testing technique, called MLT (Multilayer Transient), which makes use of downhole measurement of flowrate in addition to pressure. A production logging string, including a pressure sensor 10 and a flowmeter 11, is lowered into the well. The logging string is suspended from an electrical cable 12 which conveys measurement data to a surface equipment, not shown.

Figure 2:
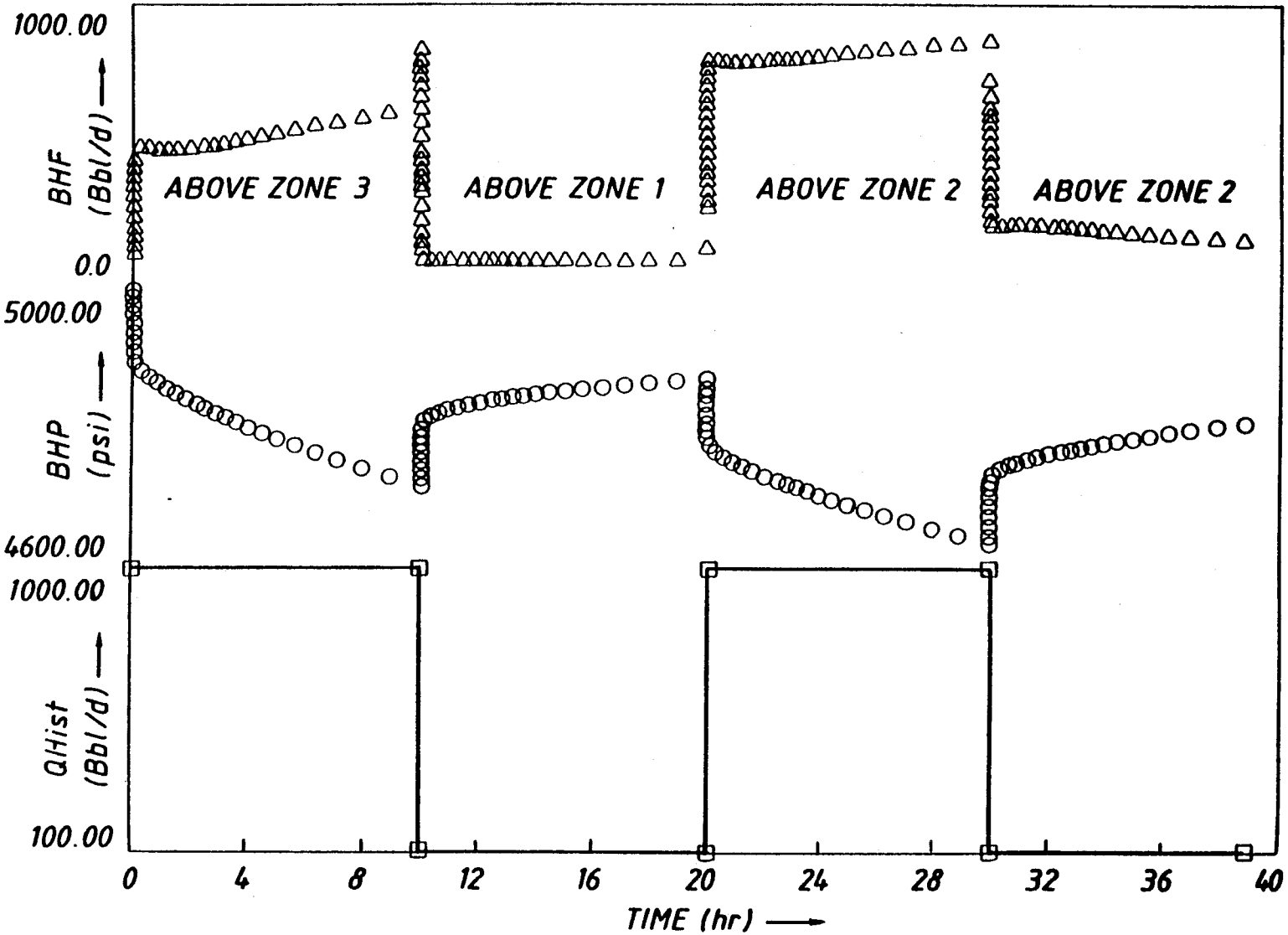
FIG. 2 shows an example of a test sequence suitable for evaluating the individual responses of the layers with the MLT technique.

For each test, starting with a change in the surface flow rate, the logging string is positioned above the layer of interest so that the flow rate measured by the flowmeter includes the contribution from that layer. The logging string is kept at this level throughout the test, and is thus caused to operate in a stationary mode. Pressure and flow rate are acquired at a high sampling rate, e.g. every second, during each test. FIG. 2 shows simulated data illustrating a possible test sequence and the acquired downhole data (with "BHP" standing for downhole pressure and "BHF" for downhole flow rate).

A method will now be described whereby a substitute for the single layer responses as obtained by isolated zone tests can be derived from MLT test data.

We assume that transient tests have been performed with the flowmeter respectively above the upper limit and below the lower limit of a zone I of the well corresponding to the layer of interest. Evidently, measurements acquired with the flowmeter below the lower limit of zone I will also be used as the flow rate measurements above the upper limit of the zone lying immediately below zone I.

Let $T_k$, $T_l$ be the start times of the two transient tests, performed with the flowmeter respectively above and below the layer of interest, and Δt the elapsed time within each test. Pressure measurements yield the variation of pressure vs. elapsed time:

$\Delta p_{wf}(T_k+\Delta t)$ for the test starting at $T_k$ $\Delta p_{wf}(T_l+\Delta_t)$ for the test starting at time Tl.

Flowrate measurements acquired at level J above zone I during the test starting at time $T_k$ yield a flow rate variation:

$$[\Delta q(T_k+\Delta t)]_J.$$

Likewise, flow rate measurements acquired at level J+1 below zone I during the test starting at time $T_l$ yield the flow rate variation:

$$[\Delta q(T_l+\Delta t)]_{J+1}.$$

We normalize the MLT data obtained during the test starting at $T_k$ by forming, for each value of elapsed time $\Delta t_i$, the ratio of the flow rate variation to the simultaneous pressure variation:

$$PNR_J(\Delta t_i) = \frac{[\Delta q(T_k + \Delta t_i)]_J}{\Delta p_{wf}(T_k + \Delta t_i)}$$

The same computation yields for the test starting at $T_l$ a ratio:

$$PNR_{J+1}(\Delta t_i) = \frac{[\Delta q(T_k + \Delta t_i)]_{J+1}}{\Delta p_{wf}(T_1 + \Delta t_i)}$$

The pressure-normalized ratios pertaining respectively to level J above zone I and level J+1 below zone I are subtractively combined to provide a time-dependent data set which characterizes the individual response of layer I.

In the described embodiment, a suitable entity is formed as the reciprocal of the difference between the ratios $PNR_J$ and $PNR_{J+1}$:

$$RPNR_I = \frac{1}{PNR_J(\Delta t_i) - PNR_{J+1}(\Delta t_i)}$$

Although the measurements above and below zone I are made at different times and follow changes in surface flow rate which may be (and are generally) different in magnitude, the ratios $PNR_J$ and $PNR_{J+1}$ may be subtracted because the normalization provides correction for flow rate fluctuations and for the magnitude of the flow rate change which has initiated the transient.

The "reciprocal pressure-normalized rate" (RPNR) pertaining to layer I is a suitable substitute for the pressure change obtained in the context of an isolated zone test. A log-log plot of the RPNR vs. elapsed time thus provides a response pattern for the layer of interest.

Likewise, the log-log derivative plot of the RPNR vs. elapsed time provides an equivalent to the pressure derivative response obtained in an isolated zone test.

Superposition effects may have to be taken into account. Superposition effects result from the fact that the well has produced at different rates. When the rate is increased from a first value Q1 to a second value Q2, the measured pressure drop will be the sum of the pressure change resulting from the change in the rate and the pressure changes resulting from previous rate changes, including Q1 (see Matthews and Russell, "Pressure Buildup and Flow Tests in Wells", pp. 14–17, Vol. 1-Henry L. Doherty series, SPE-AIME, 1967). Superposition effects may be insignificant if the change in the surface rate is a large increase. However, superposition effects may entail gross distortions in the case of a decrease in flowrate, particularly for features pertaining to reservoir boundaries.

Correction for superposition involves that derivation of the RPNR be made with respect to a superposition time function rather than to elapsed time $\Delta t$. In this respect, reference is made to a publication SPE 20550 "Pressure Desuperposition Technique for Improved Late-Time Transient Diagnosis" by C. A. Ehlig-Economides et al. The following description relies upon this work and will refer to the equations presented in this reference as "SPE 20550 Equ." followed by its number.

The RPNR derivative is computed so as to correct for superposition effects, in the manner described below in detail with reference to the flow chart of FIG. 3.

The result of the computation is the RPNR derivative for every layer. FIG. 4 shows such RPNR derivatives for zones 1, 2 and 3 and compares them with the respective single-layer pressure derivative plots which would result from the isolated zone test. It is apparent from FIG. 4 that the RPNR derivative mimics the single-layer pressure derivative as regards the meaningful features of the curves (trough, inflection points, line slopes).

The RPNR and RPNR derivative are thus efficient tools for individually characterizing a given layer i.e. for diagnosing a model for this layer.

It is to be noted that for the RPNR and RPNR derivative to be determined, no specific constraint is imposed on the test sequence. The only requirement is that in addition to pressure, measurements of downhole flow rate variations vs. time are available both above and below the layer under investigation.

Figure 3:
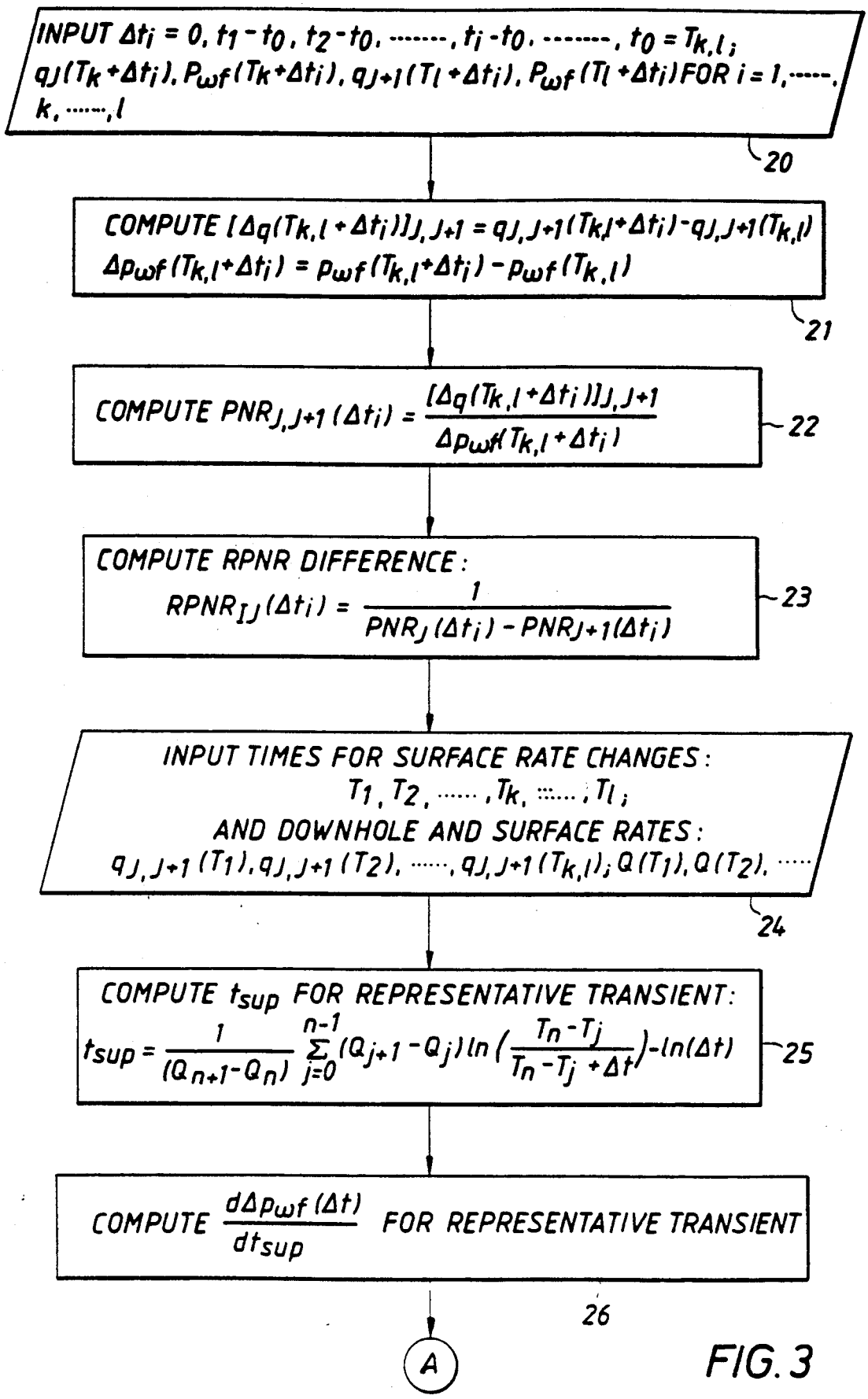
FIG. 3 is a flow chart describing the method of the invention, with rectangular blocks showing computation steps and slanted blocks showing input data for the respective computation steps.

The flow chart of FIG. 3 provides a detailed description of the steps involved in the computation of the RPNR derivative. Rectangular blocks indicate computation steps while slanted blocks indicate data inputting steps.

Input block 20 recalls the above-mentioned definitions of flow rate $q_j$, $q_{j+1}$ and pressure $p_{wf}$ measured downhole during MLT test. J is the level above the zone of interest, J+1 is the level below that zone. The elapsed time variable $\Delta t_i$ is defined within each transient test, the starting point being the time $T_k$, $T_l$, of change in the surface flow rate.

The computations of block 21 provide the pressure change variation and downhole flowrate change variation vs. elapsed time.

The respective pressure-normalized rates PNR for levels J and J+1 are computed as explained above and recalled in block 22. Block 23 recalls the computation of the RPNR pertaining to the zone lying between levels J and J+1, defined as the reciprocal of the difference of the PNR's.

Input block 24 indicates that the input data for superposition correction (also called desuperposition) are the production rate history data: the times of surface rate changes $T_1 \ldots T_l$, the surface flow rates Q(T1), Q(T2) . . . , with Q(T1) being the rate from time 0 to T1, and the downhole flow rates q(T1), etc.

Block 25 gives the expression for the superposition time function $t_{sup}$, corresponding to SPE 20550 Equations (16), (8) brought together. This function is computed for the transient which is considered representative i.e. which shows minimal distortion in its late-time period. As explained above, due to superposition, distortion will be minimal for the test which starts with the largest increase in surface rate. Block 26 indicates that the derivative of pressure variation with respect to the superposition time function $t_{sup}$ is computed for the representative transient mentioned above.

The computation of block 26 yields, for this representative transient, the derivative of pressure change with respect to the superposition time function $t_{sup}$.

From a log-log plot of this pressure derivative vs. elapsed time, the slope 'a' of the late-time portion is computed, as indicated by block 27.

Then, based on the assumption that the pressure change follows a trend represented by:

$$\Delta p_{wf}(\Delta t) = m_e(\Delta t)^a + b$$

the slope $m_e$ is computed as indicated by block 28 and explained in that portion of SPE20550 which follows Equation (21).

A desuperposition pressure function $psup_e(\Delta t_i)$ is then computed as indicated in block 29, after SPE20550 Equation (20).

This leads to a corrected pressure change:

$$\Delta p_{wf}(\Delta t_i) - psup_e(\Delta t_i).$$

Block 30 indicates that the function known in the art as a deconvolution $\Delta p_{dd}$, can then be derived from this data set.

At this point, a choice between two routes must be made depending on the "smoothness" of the deconvolution data set $\Delta p_{dd}$ obtained from the step of block 30. The data will be considered "smooth" if they provide a definable pattern. If on the contrary, the data are erratic and show no consistent pattern, they are "not smooth". Thus block 31 consists of a test as to the "smoothness" of the data set $\Delta p_{dd}(\Delta t_i)$.

The general expression for the RPNR derivative with respect to ln ($\Delta t$) is as follows:

$$\frac{DRPNR_{IJ}(\Delta t_i)}{dln(\Delta t)} = (RPNR_{IJ}(\Delta t_i))^2 \left[ \frac{dRNP_J(\Delta t_i)}{dln(\Delta t)} (PNR_J(\Delta t_i))^2 - \frac{dRNP_{J+1}(\Delta_{ti})}{dln(\Delta t)} (PNR_{J+1}(\Delta t_i))^2 \right]$$

If the answer to the test 31 is "Yes", then the RPNR derivative can be computed by substituting the deconvolution derivative $$\frac{d\Delta pdd}{dln(\Delta t)}$$

for the derivative ln ($\Delta t$) of the rate normalized pressure $RNP(\Delta t_i)$, which is the reciprocal to the pressure-normalized rate PNR.

This leads to the expression of block 32 for the RPNR derivative.

If the data are not sufficiently smooth, recourse will be had to the downhole rate-convolved time function $t_{SFRC}$, expressed by SPE20550 Equ. (24), recalled in block 33. An approximate RPNR derivative can then be computed by the expression indicated in block 34, obtained by substituting the corrected convolution derivative:

$$\frac{P_{sup}(\Delta t_i) - RNP(\Delta t_i)}{dt_{SFRC}}$$

for the derivative vs. ln($\Delta t$) of $RNP(\Delta t_i)$.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A method of characterizing flow properties of a formation layer in a multi-layer hydrocarbon reservoir traversed by a well, said method employing measurements of transient downhole fluid flow rate and transient pressure, said transient measurements performed being initiated by operator-controlled changes in a surface flow rate of the well, said method comprising the steps of:

determining, at each of several discrete time intervals after the initiation of a test, the change in downhole pressure since the initiation of the test, and the change in downhole flow rate since the initiation of the test, wherein the transient flow rate is measured above said layer during one test and below said layer during another test, normalizing each of said flow rate changes by dividing the flow rate changes by the corresponding pressure changes measured during the same test, wherein both the change in flow rate and the change in pressure are measured during the same time interval after the initiation of the test; the results of said normalization including a first pressure-normalized flow rate function for a level above said layer, and a second pressure-normalized flow rate function for a level below said layer, and subsequently subtractively combining said first and second pressure-normalized flow rate functions, wherein the result of said subtraction is a function representative of the individual flow properties of said formation layer.

2. The method of claim 1, wherein the reciprocal of the algebraic difference between said first and second pressure-normalized flow rate functions is calculated.

3. The method of claim 2, further comprising the step of differentiating said reciprocal with respect to the natural logarithm of the elapsed time, said differentiation yielding a derivative function representative of the flow properties of the layer.

4. The method of claim 3, wherein the differentiating step includes a step of correcting the derivative function for effects of superposition, said superposition resulting from changes in the surface flow rate of the well prior to each test of transient pressure and flow rate.

* * * * *